US010323399B2

(12) United States Patent
Hall et al.

(10) Patent No.: US 10,323,399 B2
(45) Date of Patent: Jun. 18, 2019

(54) MOVING AIR CURTAIN FOR TOILET BIDET DRYER

(71) Applicants: David R. Hall, Provo, UT (US); Dan Allen, Springville, UT (US); Jared Reynolds, Pleasant Grove, UT (US); Joshua Larsen, Spanish Fork, UT (US); Jared Wagner, Provo, UT (US); Terrece Pearman, Draper, UT (US)

(72) Inventors: David R. Hall, Provo, UT (US); Dan Allen, Springville, UT (US); Jared Reynolds, Pleasant Grove, UT (US); Joshua Larsen, Spanish Fork, UT (US); Jared Wagner, Provo, UT (US); Terrece Pearman, Draper, UT (US)

( * ) Notice: Subject to any disclaimer, the term of this patent is extended or adjusted under 35 U.S.C. 154(b) by 82 days.

(21) Appl. No.: 15/290,412

(22) Filed: Oct. 11, 2016

(65) Prior Publication Data

US 2017/0260729 A1 Sep. 14, 2017

Related U.S. Application Data

(60) Provisional application No. 62/305,182, filed on Mar. 8, 2016.

(51) Int. Cl.

| | |
|---|---|
| ***E03D 9/08*** | (2006.01) |
| ***A47K 10/48*** | (2006.01) |
| ***F26B 21/00*** | (2006.01) |

(52) U.S. Cl.
CPC ..... *E03D 9/08* (2013.01); *A47K 10/48* (2013.01); *F26B 21/004* (2013.01)

(58) Field of Classification Search
CPC ..... E03D 9/08; A47K 10/48; F26B 21/004
USPC ..... 4/420.1, 420.4, 420.5, 444, 447, 448
See application file for complete search history.

(56) References Cited

U.S. PATENT DOCUMENTS

| | | | | |
|---|---|---|---|---|
| 6,769,140 | B1 * | 8/2004 | Olivier | E03D 9/08 4/420.4 |
| 9,212,477 | B2 * | 12/2015 | Tiagai | E03D 9/08 |
| 9,428,898 | B1 * | 8/2016 | Clements | E03D 9/08 |
| 2013/0227775 | A1 * | 9/2013 | Frei | E03D 9/08 4/448 |

* cited by examiner

*Primary Examiner* — Tuan N Nguyen

(57) ABSTRACT

A dryer for use with a bidet is disclosed. In one embodiment, a moveable dryer wand emits an air curtain as the dryer wand moves across the bidet bowl beneath the user after cleansing. We further disclose a dryer which produces a second air current which moves air in a different direction than that emitted by the dryer wand and further controls the movement of excess water remaining on a user after cleansing. A dryer that includes moveable dryer wand used in coordination with a moveable bidet wand are also disclosed and claimed herein.

9 Claims, 10 Drawing Sheets

MOVING AIR CURTAIN FOR TOILET BIDET DRYER

CROSS-REFERENCE TO RELATED APPLICATIONS

This application claims priority to U.S. provisional patent application Ser. No. 62/305,182 filed on Mar. 8, 2016, the entire contents of which is hereby incorporated by reference.

BACKGROUND

Field of the Invention

This invention relates bidets and bidet dryers.

Background of the Invention

The use of bidets is a hygienic option for cleansing the anus and genitals after using the toilet. It is ecologically friendly by reducing or eliminating the need for toilet paper. Also, bidets enable those who otherwise have difficulty toileting themselves because they lack the manual dexterity needed to manually wipe with toilet paper to use the toilet without assistance.

Bidets spray water onto a user to accomplish cleansing after using the toilet. Some bidets include dryers to remove water left behind by the bidet. Conventional dryers that accompany bidets typically comprise of a stationary dryer that blows air laterally from a fixed position. Alternatively, other conventional dryers blow air from a fixed point located at the rear of the toilet bowl causing the unsanitary water to move from the user's anus toward the genitals and urethra. This is particularly problematic for female users who are more likely than males to acquire urinary tract infections.

A bidet dryer designed to improve hygiene and reduce the opportunity for infection is needed.

SUMMARY

This invention has been developed in response to the present state of the art and, in particular, in response to the problems and needs in the art that have not yet been fully solved by currently available bidet dryer systems. Accordingly, an improved dryer for a bidet has been developed. Features and advantages of different embodiments of the invention will become more fully apparent from the following description and appended claims, or may be learned by practice of the invention as set forth hereinafter.

Consistent with the foregoing, a bidet dryer which emits an air curtain from a moveable dryer wand is disclosed. The dryer wand may move beneath the user after cleansing by a bidet wand. The aperture on the dryer wand may be angled such that it maneuvers the air flow in a direction that drives water remaining on a user in a direction that is more sanitary than conventional dryers. For example, the air curtain may drive water from the front to back as a user sits on the bidet.

A moveable dryer wand used in conjunction with a moveable bidet wand is also disclosed. The bidet wand may move across the bidet bowl, beneath the user, while it emits water to cleanse the user. The dryer wand may subsequently follow the path of the bidet wand to dry the user.

A dryer system which includes a second air curtain which emits an air current in a second direction to further control the movement of excess water left on the user is also disclosed. In some embodiments, the moveable dryer wand, the second air current, the air flow, and/or the moveable bidet wand are regulated by one or more controllers.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

We disclose a dryer system for use in a bidet. The dryer system produces at least one air curtain which may be emitted by a moveable dryer wand. The dryer wand moves across the bidet bowl, beneath the user, and directs the movement of excess water in a controlled direction. This direction may be designed to improve sanitation by controlling the motion of unsanitary water that remains on the user after cleansing with a bidet wand.

We further disclose embodiments of the dryer system which include a moveable bidet wand. The dryer system dries the user in a coordinated method in conjunction with the cleansing action of the bidet wand.

Figure 1A:
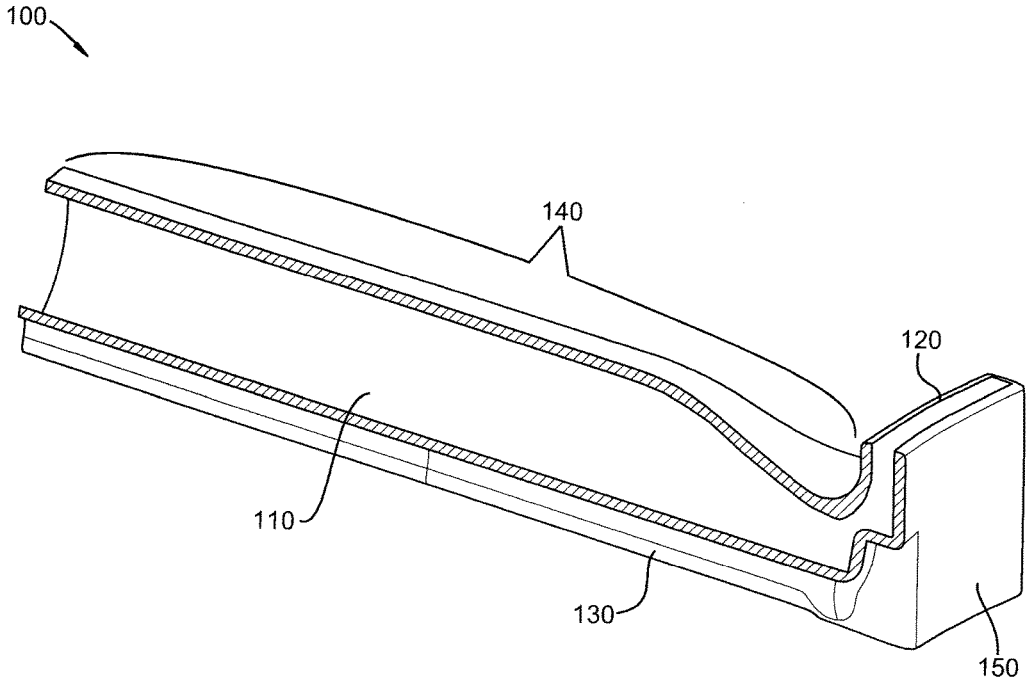
FIG. 1A shows a cross section of a dryer according to an embodiment of the invention.

Referring to FIG. 1A, an embodiment of the invention, dryer wand 100, is shown. Dryer wand 100 includes a hollow tube 140 that conducts a first air current through its interior cavity 110. The air current may be generated by a fan or other apparatus that creates air currents. Hollow tube 140 includes a first end and a second end. In this embodiment, the first air current moves from the second end toward the first end of hollow tube 140. Also in this embodiment, the first end is connected to air nozzle 150. Air nozzle 150 includes a first aperture 120 which is an air vent through which the first air current leaves dryer wand 100. While first aperture 120 may comprise of a variety of cross-sectional shapes, it may be wider in one direction than the other. This elongated shape creates an air curtain. Examples of cross-sectional shapes of first aperture 120 include, but are not limited to, approximately rectangular and approximately a segment of an annulus. First aperture 120 may be positioned approximately perpendicular to hollow tube 140. In other embodiments, first aperture 120 is angled toward hollow tube 140 at approximately an angle of 3°. Furthermore, as discussed more detail below, dryer wand 100 may move along a translational axis which causes the air curtain to contact a limited area of a user's body at any given time while moving along the surface of the user's body. The air curtain may push excess water in the direction in which first aperture 120 is moving, drying the surface of the users body as it moves along. FIG. 1A includes groove 130 in which a bidet wand may be positioned for dispensing water prior to drying.

Dryer wand 100 may be connected to a track which runs in the direction of the translational axis or other means for moving dryer wand 100. Power to create this movement may be generated by a motor. In some embodiments, this motor is located within the bidet housing. Furthermore, the embodiment of FIG. 1A includes groove 130 in which a bidet wand may be positioned for dispensing water prior to drying. In the embodiment in which a bidet wand is positioned within groove 130, dryer wand 100 and the bidet wand may move independently along the track to cleans then dry the user. Separate motors may drive dryer wand 100 and the bidet wand to create the independent movement.

Figure 1B:
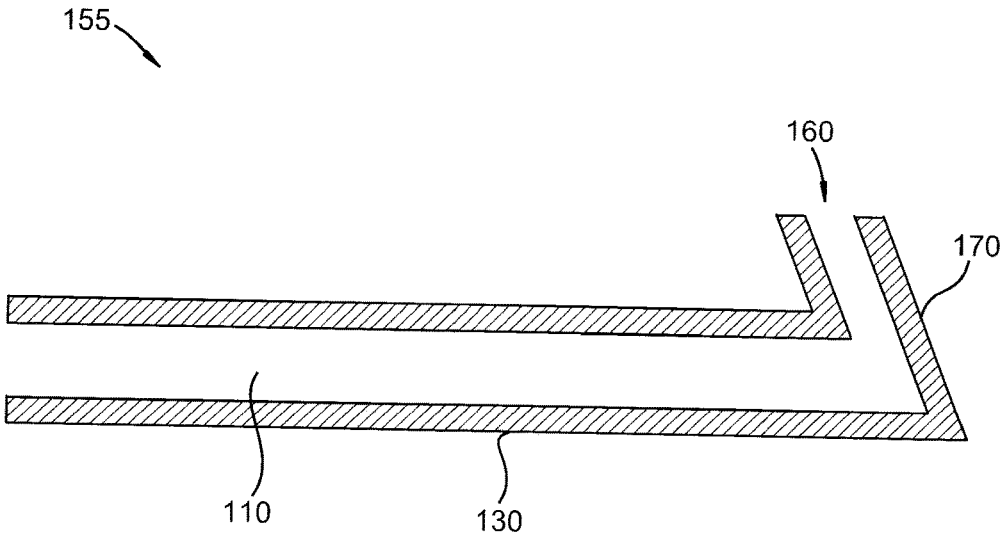
FIG. 1B shows a cross section of a side view of a dryer according to an embodiment of the invention, the embodiment differing from that of FIG. 1A.

FIG. 1B illustrates dryer wand 155 which is an alternative embodiment of a dryer wand. In this embodiment, air nozzle 170 differs from that shown in FIG. 1A in that air nozzle 170 is angled further back toward the second end of hollow tube 140. This design directs the air curtain such that it is emitted from aperture 160 towards the user from a different angle than that of the embodiment shown in FIG. 1A. An increased angle may move excess water backwards toward the user's anus as dryer wand 155 retracts and moves from the front of the bidet bowl to the rear of the bidet bowl. This ensures that unsanitary water is moved away from the user's genitals and urethra, thus reducing the likelihood of a urinary tract infection.

Figure 1C:
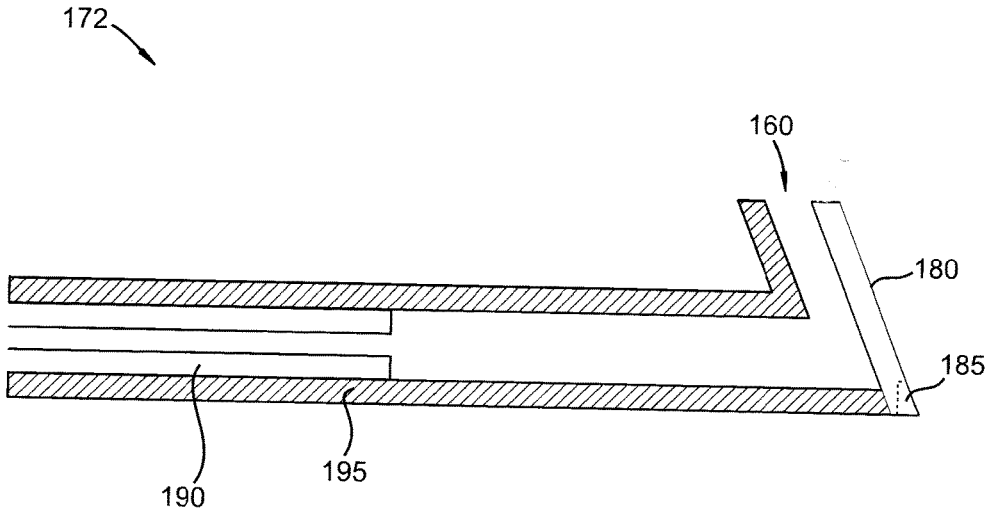
FIG. 1C shows a cross section of a side view of a dryer comprising a hinge according to an embodiment of the invention.

FIG. 1C illustrates yet another embodiment of a dryer wand. Dryer wand 172 includes hollow tube 195 and air nozzle 180. Like other embodiments, hollow tube 195 includes a first end which is connected to air nozzle 180 and a second end. Dryer wand 172 further includes hinge 185. Air nozzle 180 may hingedly move on hinge 185 thus changing the angle of air nozzle 180 relative to hollow tube 195. This alters the direction of the air curtain emitted by aperture 160. The embodiment of FIG. 1C includes slide track 190 on which the outer wall of hollow tube 195 slides. As air nozzle 180 hingedly moves toward the second end of hollow tube 195, the housing of hollow tube 195 slides backward along track 190 and away from air nozzle 180. This movement provides space for air nozzle 180 to move toward the second end of hollow tube 195. The direction of the air curtain emitted form air nozzle 180 may be varied as air nozzle 180 changes angle. This may provide more thorough drying with greater control of the direction in which the excess water is directed.

Figure 2:
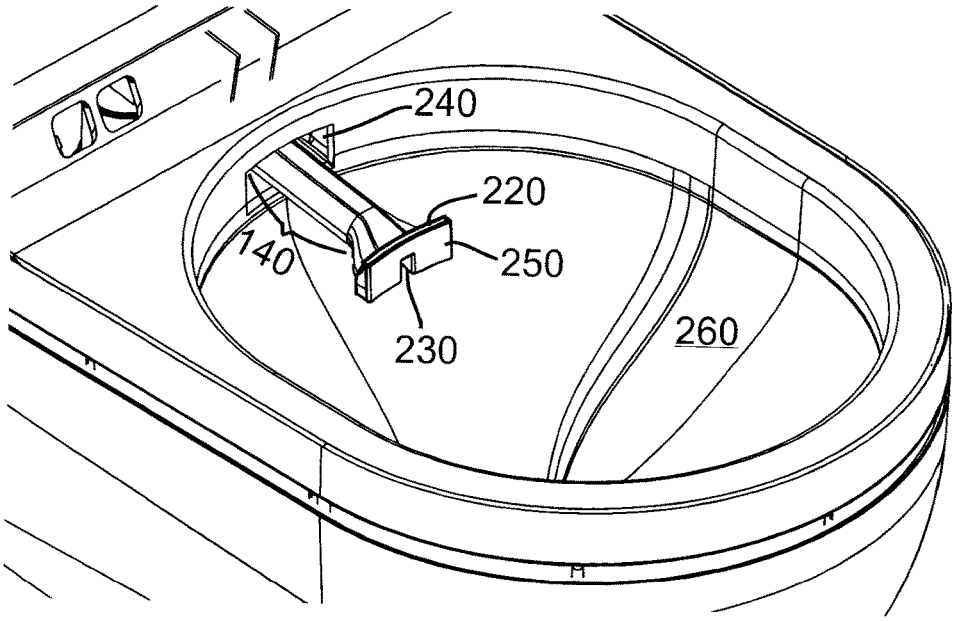
FIG. 2 shows a perspective view of a bidet with an embodiment of a bidet dryer according to an embodiment of the invention.

FIG. 2 illustrates an embodiment of a dryer wand within a bidet. The bidet of FIG. 2 includes bidet bowl 260 with opening 240 located at the rear. The bidet wand includes air nozzle 250 with aperture 220. This embodiment further includes groove 230 in which a bidet wand may be positioned. The dryer wand, and bidet wand, if present, move in and out of opening 240 while passing underneath a user. A fan may initiate the air current at an appropriate time which may be initiated by a controller. For example, the dryer wand may fully extend beneath a user without emitting air then the controller may initiate the flow of air. The air curtain may drive the excess water backward from front to back as the dryer wand retracts. The dryer wand may then return into opening 240 until its next use.

Figure 3A:
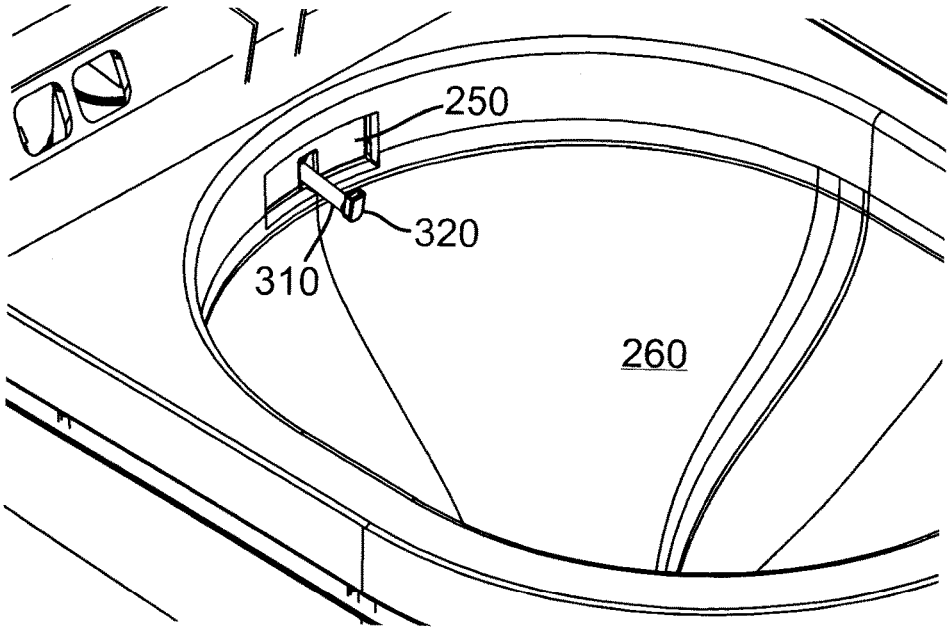
FIG. 3A shows a perspective view of a bidet with the bidet wand slightly extended and the dryer retracted.
Figure 3B:
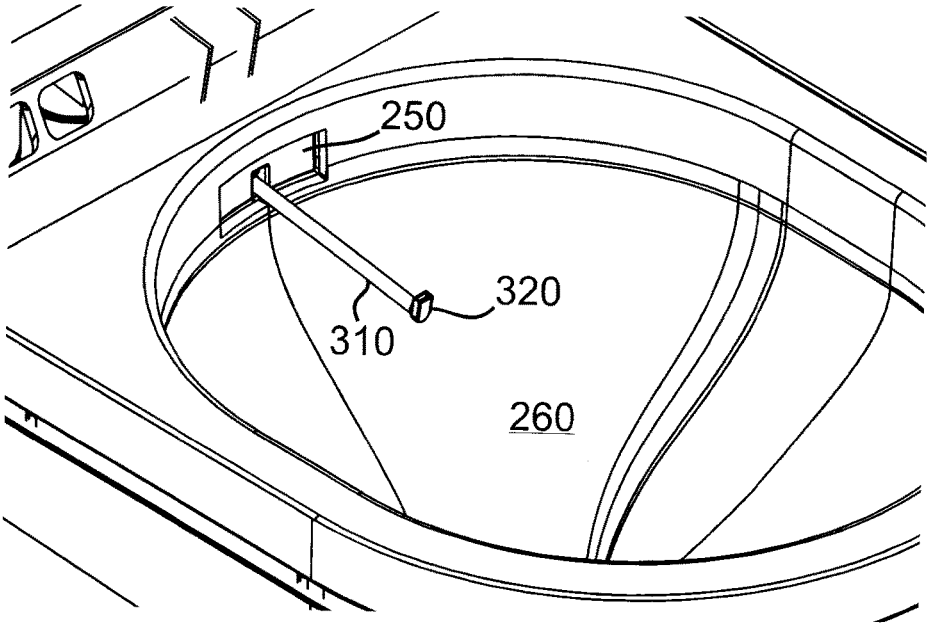
FIG. 3B shows a perspective view of a bidet with the bidet wand extended further than shown in FIG. 3A and the dryer wand retracted.

FIGS. 3A-3D illustrate the movement of an embodiment of the dryer wand with a moveable bidet wand. This embodiment includes a bidet wand positioned in a groove within a dryer wand. FIG. 3A illustrates air nozzle 250 when the dryer wand is in its fully retracted position. The bidet wand comprising bidet wand shaft 310 and water nozzle 320 is shown as it begins to emerge towards the interior of bidet bowl 260. FIG. 3B illustrates the bidet wand in a position in which bidet wand shaft 310 is further extended into bidet bowl 260. A second motor, separate from the first motor that may drive the movement of the dryer wand, may drive the movement of the bidet wand such that the two parts may move independent of each other. A controller may determine at what point during the movement of the bidet wand water begins to emit form water nozzle 320. Water nozzle 320 may begin to emit water as it begins to extend. Alternatively, water nozzle 320 may begin to emit water only after the bidet wand has reached its fully extended position. In the latter embodiment, the user is cleansed from front to back of the user as the bidet wand retracts toward the rear of bidet bowl 260.

Figure 3C:
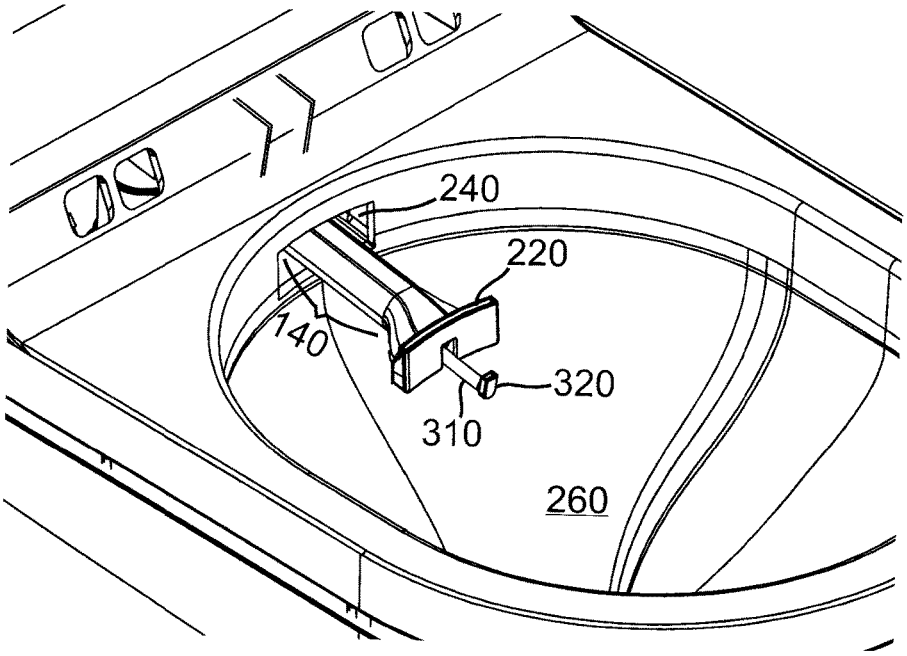
FIG. 3C shows a perspective view of a bidet with the bidet want beginning to retract as the dryer extends.

FIG. 3C illustrates an embodiment of a dryer wand as it extends from opening 240. The bidet wand continues to retract as the dryer wand extends. In some embodiments, water nozzle 320 may continue to emit water after it is completely covered from above by the dryer wand. The force of the water stream prevents unsanitary water from falling back from a user onto water nozzle 320. This is because fresh water from water nozzle 320 forces the unsanitary water away from nozzle 320 until nozzle 320 is covered. At an appropriate time, which may be initiated by a controller, first aperture 320 may begin to emit an air curtain to begin drying the user.

Figure 3D:
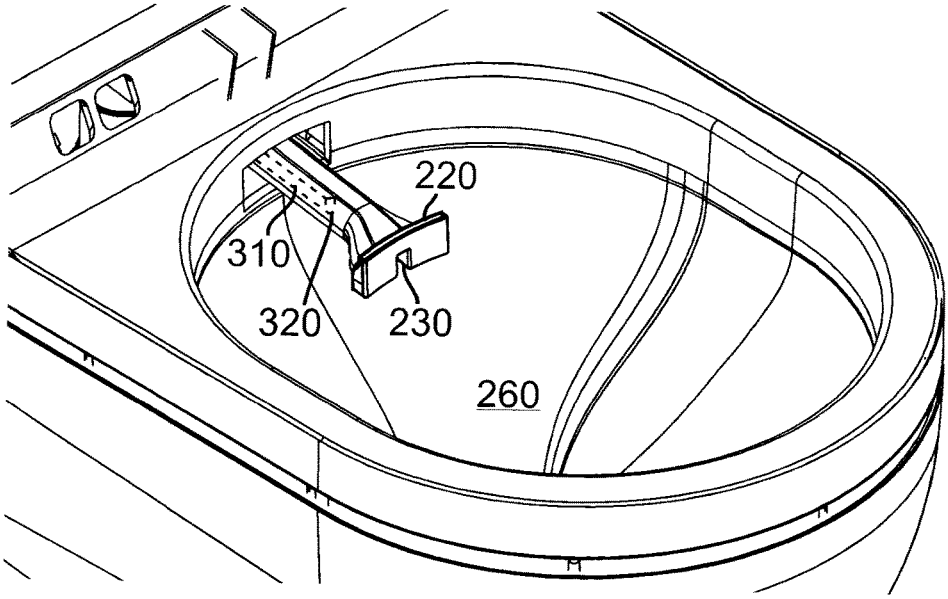
FIG. 3D shows a perspective view of a bidet with the bidet wand retracted and the dryer extended.

FIG. 3D shows the bidet wand such that it is retracted to a point where it is covered by the dryer wand. At this point, cleansing of the user is complete and the dryer wand emits an air curtain from first aperture 220 which dries the user. Eventually, the bidet wand will reach its fully-retracted position and the dryer wand will fully extend then return to its fully retracted position within opening 240.

Figure 4:
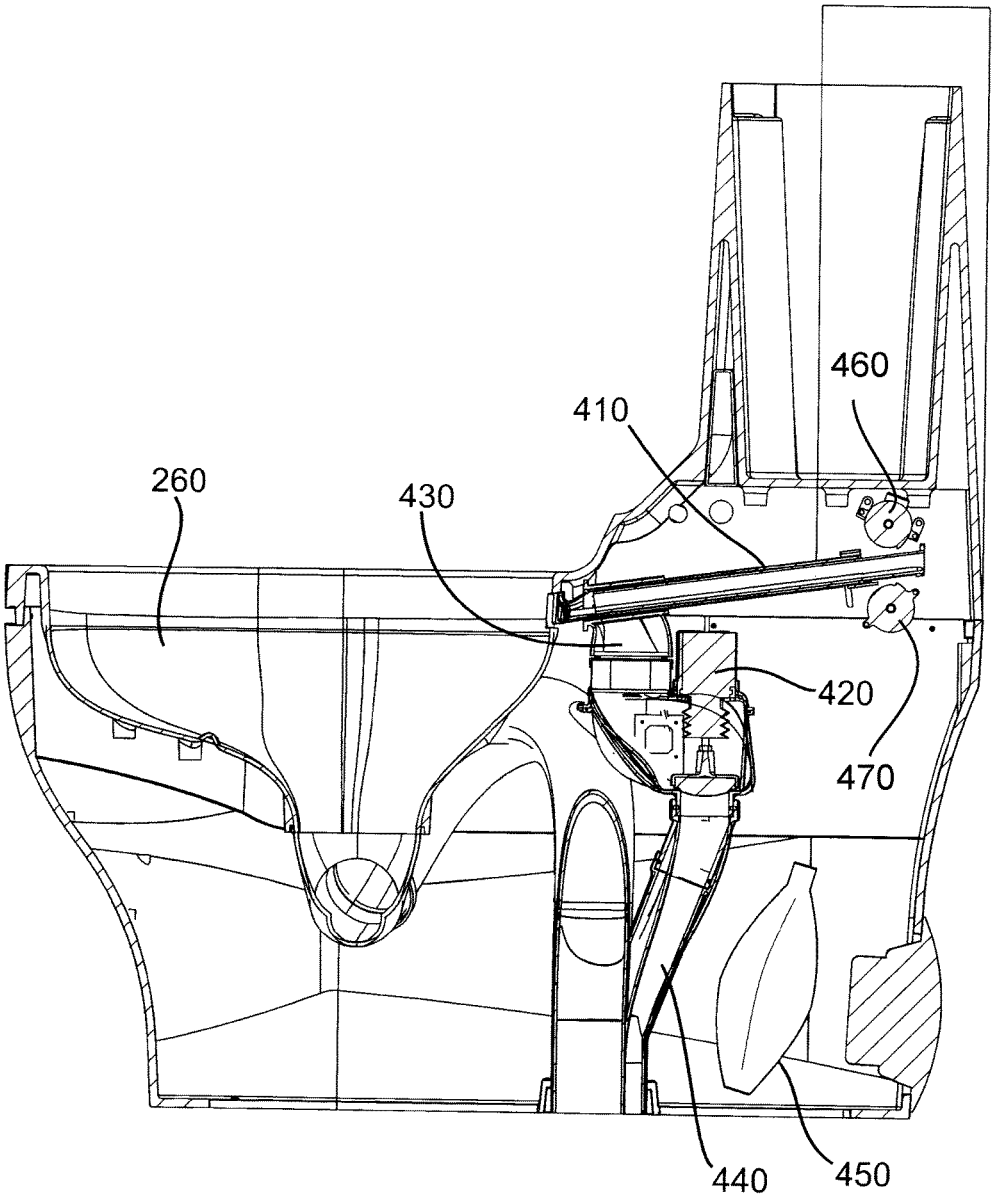
FIG. 4 shows a cross-section of a bidet with a dryer according to an embodiment of the invention.

FIG. 4 shows a cross-section of a bidet that includes an embodiment of the dryer according to the invention. In this embodiment, the movement of dryer wand 410 and a bidet wand are each driven by separate motors. The air current emitted by dryer wand 410 is generated by fan 450. As described herein, this air current is emitted by a first aperture in an air nozzle creating an air curtain to dry a user. The embodiment of FIG. 4 further includes fan 420. Fan 420 may generate an air current that pulls waste water that may be present within housing 430 into wastewater pipe 440. Housing 430 covers the dryer wand and, in some embodiments, the bidet wand. Consequently, removing wastewater from within housing 430 removes unsanitary water that may be clinging to the bidet wand and/or the dryer wand. Wastewater pipe 440 is connected to a sewer pipe which directs the wastewater into the sewer system.

Figure 5:
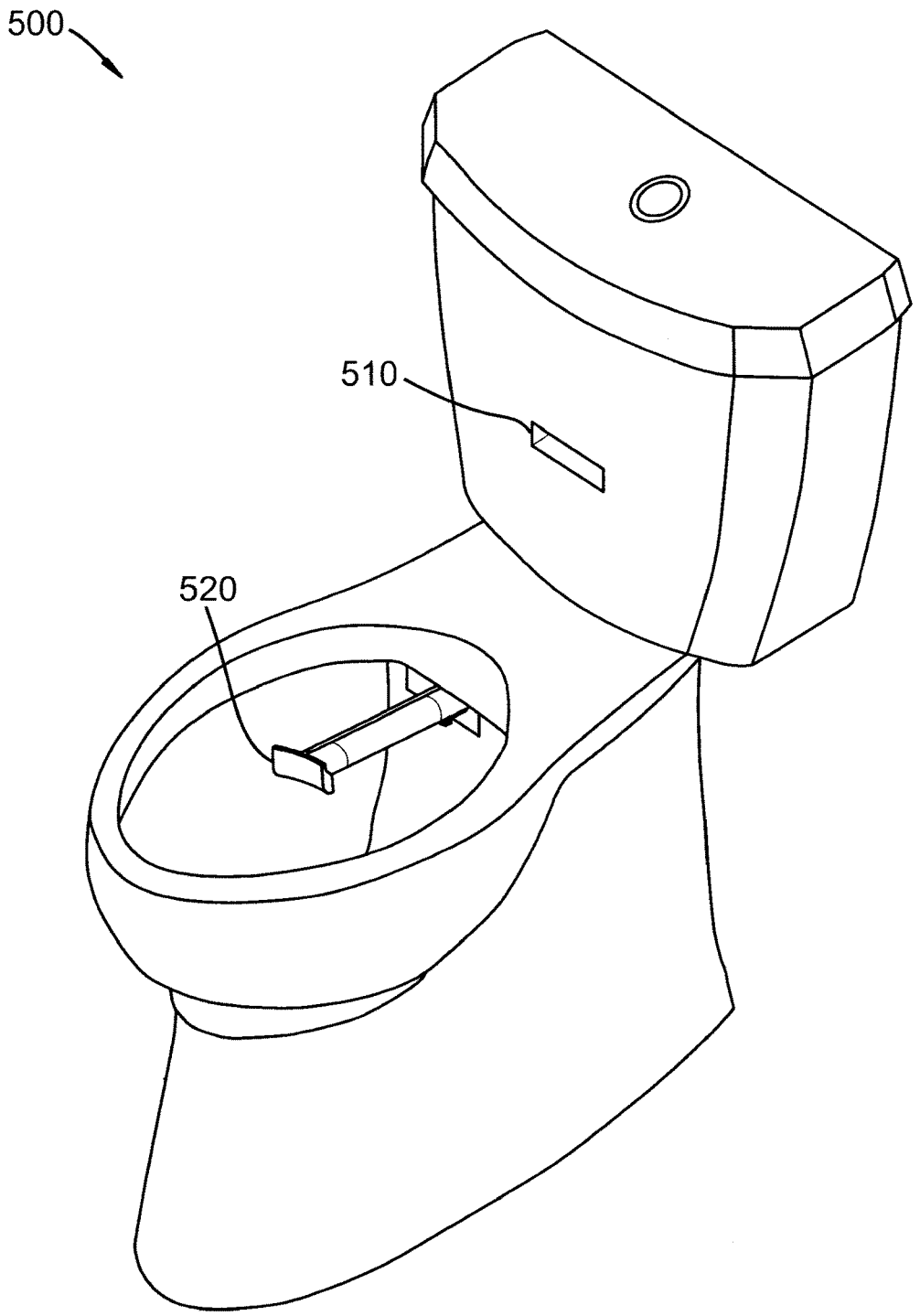
FIG. 5 show a bidet including an embodiment of the invention which includes a second air curtain to dry the user.

FIG. 5 illustrates a further embodiment of the invention. Bidet 500 comprises fixture 510. In this embodiment, fixture 510 is mounted on the rear side of the bidet housing above the bidet bowl. Fixture 510 comprises a second aperture which emits an air current to dry a user after cleansing. The air current emitted from the second aperture may be generated by a third fan. The second aperture of fixture 510 may be angled downward toward a user's lower back so as to drive excess water remaining on the user during cleansing downward. Similar to the aperture on the dryer wand, while the second aperture of fixture 510 may be comprised of a variety of cross-sectional shapes, it may be wider in one direction than the other. Examples of cross-sectional shapes of the second aperture include, but are not limited to, approximately rectangular and approximately a segment of an annulus. This elongated shape creates an air curtain.

Bidet 500 further comprises dryer wand 520. Dryer wand 520 may be used to dry the user after cleansing in conjunction with fixture 510. In this embodiment, dryer wand 520 emits an air curtain in approximately an upward direction as dryer wand 520 moves beneath the user. Unopposed, this upward air curtain could drive excess water up toward the user's lower back. The air curtain emitted by fixture 510 may be aimed in a different direction than the air curtain emitted by dryer wand 520, including, but not limited to, approximately a downward direction. The two air curtains, thus, at least somewhat oppose each other. Consequently, the air current emitted from fixture 510 prevents the excess water from moving upward, and keeps the user's back dry.

In some embodiments of the invention some moveable components of the dryer are maneuvered by a controller. These components include the dryer wand and the bidet wand. The controller may be connected to the fan that drives the air current through the dryer wand. The controller may further include a plurality of air curtain flow settings, thus providing a different amount of air to flow through the dryer wand at different times. The different air curtain flow settings may be selected according to the position of the dryer wand. For example, a lower setting may be used as the dryer wand moves towards the user's front being more gentle on the user's urethra and genitals while a higher setting may be used as the dryer wand passes over the user's anus.

The apparatuses disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A dryer for use in a bidet, the dryer comprising:
- a moveable drying wand, the drying wand comprising:
  - a hollow tube,
  - a groove, the groove running longitudinally along a length of the drying wand,
  - an air nozzle,
    - wherein the air nozzle is connected to a distal end of the hollow tube, and
    - wherein the air nozzle comprises a first aperture,
      - wherein a first dimension of the air nozzle is wider than a second dimension of the air nozzle, wherein the first dimension of the air nozzle is perpendicular to the second dimension of the air nozzle, and wherein the air nozzle is positioned at an angle toward an opening in a bidet bowl relative to a plane that is perpendicular to the hollow tube;
- a bidet wand,
  - wherein the bidet wand is movably disposed within the groove,
- a plurality of fans wherein the fans moves a first and a second air current through the hollow tube in a direction that is toward or away from the first aperture; and
- a fixture for conducting a third air current,
  - wherein the fixture comprises a second aperture,
  - wherein the second aperture is narrower in a first dimension of the second aperture is narrower than a second dimension of the second aperture,
    - wherein the first dimension of the second aperture is perpendicular to the second dimension of the second aperture, and
    - wherein the fixture is positioned above the drying wand.

2. The dryer of claim 1, wherein the angle of the air nozzle is three degrees.

3. The dryer of claim 1, wherein the air nozzle is hingedly attached to the hollow tube.

4. The dryer of claim 3, wherein the air nozzle is moveable to a plurality of angles relative to the hollow tube.

5. The dryer of claim 1, wherein a cross-sectional shape of the first aperture is rectangular.

6. The dryer of claim 1, wherein a cross-sectional shape of the first aperture is a segment of an annulus.

7. The dryer of claim 1, wherein a width of the first aperture is wider than a width of the hollow tube.

8. The dryer of claim 1, wherein a cross-sectional shape of the second aperture is rectangular.

9. The dryer of claim 1, wherein a cross-sectional shape of the second aperture is a segment of an annulus.

* * * * *